US006062939A

United States Patent [19]

Parker et al.

[11] Patent Number: 6,062,939

[45] Date of Patent: May 16, 2000

[54] TOY POWER TOOL

[75] Inventors: Kenneth G. Parker, Williamsville; Gary E. Weber, Buffalo; John D. DeRubes, North Tonawanda; Jerry May, Colden; Joseph E. Hoppy, East Aurora, all of N.Y.

[73] Assignee: Mattel, Inc., El Segundo, Calif.

[21] Appl. No.: 09/130,516

[22] Filed: Aug. 7, 1998

[51] Int. Cl.[7] ..... A63H 33/30; A63H 5/04

[52] U.S. Cl. ..... 446/145; 446/406; 81/177.7

[58] Field of Search ..... 446/1, 38, 40, 446/102, 104, 144, 145, 240, 246, 266, 404, 405, 406; 81/177.7, 177.8

[56] References Cited

U.S. PATENT DOCUMENTS

| | | | |
|---|---|---|---|
| 4,932,913 | 6/1990 | Raviv et al. | 446/404 |
| 5,785,572 | 6/1998 | Levy et al. | 446/144 |

FOREIGN PATENT DOCUMENTS

| | | | |
|---|---|---|---|
| 716766 | 8/1965 | Canada | 446/38 |

*Primary Examiner*—D. Neal Muir

[57] ABSTRACT

A toy power tool is shown having a tool-holding housing and a handle housing rotatably connected at interfacing surfaces inclined to the central axes of both housings. Relative rotation of the housing about a transformation axis perpendicular to the inclined interfacing surfaces transforms the tool from one desired configuration to another. A 180° rotation of the tool-holding housing relative to the handle housing transforms the tool between a straight configuration with the central axes of the housings being aligned, and a L-shaped configuration with the central axes of the housings being at right-angles. Detents between the interfacing surfaces position the housings at the desired configurations, and double as switches that are connected to a sound producing circuit on a printed circuit board mounted parallel to the interfacing surfaces. An internal gear mechanism converts linear input motion to the relative rotary motion of the housings. The detents between the interfacing surfaces create more resistance to relative rotation of the housings in one direction than the other, thus causing the clutch spur gear to slip relative to the clutch bevel gear in one direction and engage in the other, causing transformation of the housings. Tools are mounted for movement into and out of the housings, with simulated cutting sounds being produced when a trigger is actuated at the same time as the tool is pressed into the housing.

28 Claims, 12 Drawing Sheets

TOY POWER TOOL

BACKGROUND OF THE INVENTION

1. Field of the Invention

The present invention relates to toy power tools, and more particularly, toy power tools that can transform from one configuration to another and that produce cutting sounds and motor sounds during use.

2. Description of the Related Art

U.S. Pat. No. 5,217,402 discloses a sound producing toy that simulates several aspects of typical workbench activity. The sound production is coordinated with the motion and activity of the elements of the workbench toy. The sounds are only produced as a result of accessory elements being inserted into receptacles in the workbench.

U.S. Pat. No. 5,069,091 discloses an actual screwdriver with a pivotal handle. The user must grasp both the front portion of the tool adapted to carry the tool and the rear portion that is pivotally mounted to the front portion in order to change the configuration of the tool. Transformation of the tool to and from a high torque configuration simply involves manually pivoting the rear handle portion about an axis transverse to the tool axis. The pivotal screwdriver is also only manually operable and does not produce any motor sounds.

Conventional toy tools lack any means for transforming the tool configuration through a motion that is different from an input actuation motion. When a child can immediately see the mechanism by which the tool is changing shape, such as where the child has to physically grasp one portion of the tool and move it into another configuration, interest in the toy will quickly pass. A toy with some educational value as well as the ability to hold a child's interest for a long period of time would be preferable. Such a toy could include features that make it appear to a child to magically transform from one configuration to another as a result of the child's input, and that simultaneously stimulate other senses such as hearing.

SUMMARY OF THE INVENTION

The present invention has been made in view of the above circumstances and provides a toy tool having a tool-holding housing and a handle housing that are rotatably connected at interfacing surfaces. The interfacing surfaces lie parallel to a plane that is inclined relative to the central axes of both the tool-holding and handle housings. Rotation of the housings relative to each other about a transformation axis that is perpendicular to the interfacing surfaces changes the angle between the central axes of the housings. In a preferred embodiment, a 180° turn of the housings relative to each other transforms the tool between a straight configuration, with the central axes of the housings being aligned, to an L-shaped configuration, with the central axes of the housings being at right angles to each other.

An actuating mechanism in the tool converts a linear input, such as produced by depressing a button on the tool, to the relative rotational movement between the housings. In a preferred embodiment, movement of the button causes a connected rack gear to rotate a spur gear, with the spur gear being connected via a clutch to a series of bevel gears. The final bevel gear in the series of bevel gears is fixedly connected with the tool-holding housing, so rotation of the spur gear with the clutch engaged causes rotation of the tool-holding housing. The clutch can be constructed such that the spur gear engages with one of the bevel gears and rotates the bevel gears when the spur gear is rotated in one of a first or a second direction.

In a preferred embodiment the clutch spur gear is provided with two 180° spaced clutch teeth on one side face that engage with two 180° spaced clutch teeth on one side of the clutch bevel gear. The clutch spur gear is biased laterally in the direction of its central axis by a compression spring into contact with a side of the clutch bevel gear. The clutch spur gear is rotated in a first direction as the button and rack gear enter the handle, and rotated in a second direction as the button and rack gear are returned to an extended position by another spring.

Detents can be provided between the interfacing surfaces of the tool-holding housing and the handle housing to positively position the two housings relative to each other at desired predetermined configurations. In a preferred embodiment the detents are spaced 180° apart to position the two housings with their central axes aligned or perpendicular. It will be clear to the artisan that additional detents could be provided at different spacings to allow for positive positioning of the housings at additional configurations. The detents can also be spring switches associated with the sound producing circuits on a printed circuit board mounted parallel to the interfacing surfaces in either of the housings.

A number of design factors taken in combination determine whether the two housings will rotate relative to each other as the actuation button is depressed, or as the button returns to its extended position. One design factor is the amount of resistance that the detents impose to relative rotation between the housings in first and second directions. Other factors could include the slope of the leading and trailing faces of the engaged clutch teeth on the clutch spur and clutch bevel gears, and the lateral spring force biasing the clutch teeth of the spur gear into contact with the clutch teeth of the bevel gear. These factors can be selected so that the clutch spur gear will rotate in synchronization with the clutch bevel gear in the first direction and slip relative to the bevel gear in the second direction, or vice versa. Accordingly, the toy tool can undergo transformation when the actuator button is pushed into the handle housing, or upon return of the button from a fully depressed state to an extended position.

According to another aspect of the invention, a simulated tool such as one of a toy screwdriver blade, a toy drill bit, a toy reciprocating saw and a toy jigsaw is mounted in the tool-holding housing for movement into and out of the housing. In a preferred embodiment, a lost motion mechanism allows a relatively large amount of movement of the toy tool into the housing to be translated into a small amount of movement necessary to actuate a switch associated with a sound producing circuit. The sound producing circuit is on the printed circuit board mounted parallel to one of the interfacing surfaces of the tool-holding housing and the handle housing. The sound producing circuit can produce cutting sounds characteristic of the tool bit being used, and also electronic motor sounds. The electronic motor sounds are produced during the transformation of the tool and when a trigger on the toy is actuated without exerting any pressure on the tool bit. In a preferred embodiment, the cutting sounds will only be produced if the trigger on the toy tool is actuated at the same time as the tool bit is pressed into the tool-holding housing.

When an external force is exerted on the drill bit, for example, the drill bit compresses a first spring for a first distance as it moves telescopically over one end of a guide shaft. The opposite end of the guide shaft contacts a switch that has a spring weaker than the first spring to allow immediate actuation of cutting sounds as the tool bit is pressed into the housing. The switch bottoms out against stops when it is actuated, and then the drill bit continues to travel along the guide shaft compressing the first spring.

In an alternative embodiment, a jigsaw can be pressed into the tool-holding housing by a first distance parallel to the central axis of the tool-holding housing before a cam surface on the jigsaw blade contacts a cam surface on a switch actuator. The cam surface on the jigsaw blade is positioned at an oblique angle to the central axis of the tool-holding housing and is parallel to the cam surface on the switch actuator. The switch actuator is guided for movement in a direction perpendicular to the cam surfaces as the cam surfaces slide along one another with continued travel of the simulated jigsaw into the housing. Accordingly, the movement of the switch actuator is in a direction perpendicular to the interfacing surfaces of the tool-holding housing and the handle housing and is only a fraction of the amount of movement of the jigsaw blade parallel to the tool-holding housing.

The switches actuated by movement of the toy tools into the housing are associated with sound producing circuits to simulate cutting sounds. The detents that protrude through aligned openings in the interfacing surfaces of the housings when the tool is in one of the predetermined desired configurations also can double as switches associated with the sound producing circuits on the printed circuit board. In the preferred embodiment the detents protrude through openings in the interfacing surfaces spaced 180° apart when the toy tool is in either a straight or right-angled configuration. When the tool-holding housing is rotated relative to the handle housing, both detents are depressed by one of the interfacing surfaces, and both associated spring switches are closed, thus producing electronic motor sounds. Alternatively, a separate switch could be provided at an intermediate position between the detents such that the separate switch is actuated by relative rotation of the housings away from the predetermined desired configurations, thus producing a simulated electronic transformation sound.

BRIEF DESCRIPTION OF THE DRAWINGS

The accompanying drawings, which are incorporated in and constitute a part of this specification, illustrate several embodiments of the invention and together with the description, serve to explain the principles and operation of the invention.

DESCRIPTION OF THE PREFERRED EMBODIMENT

Figure 1:
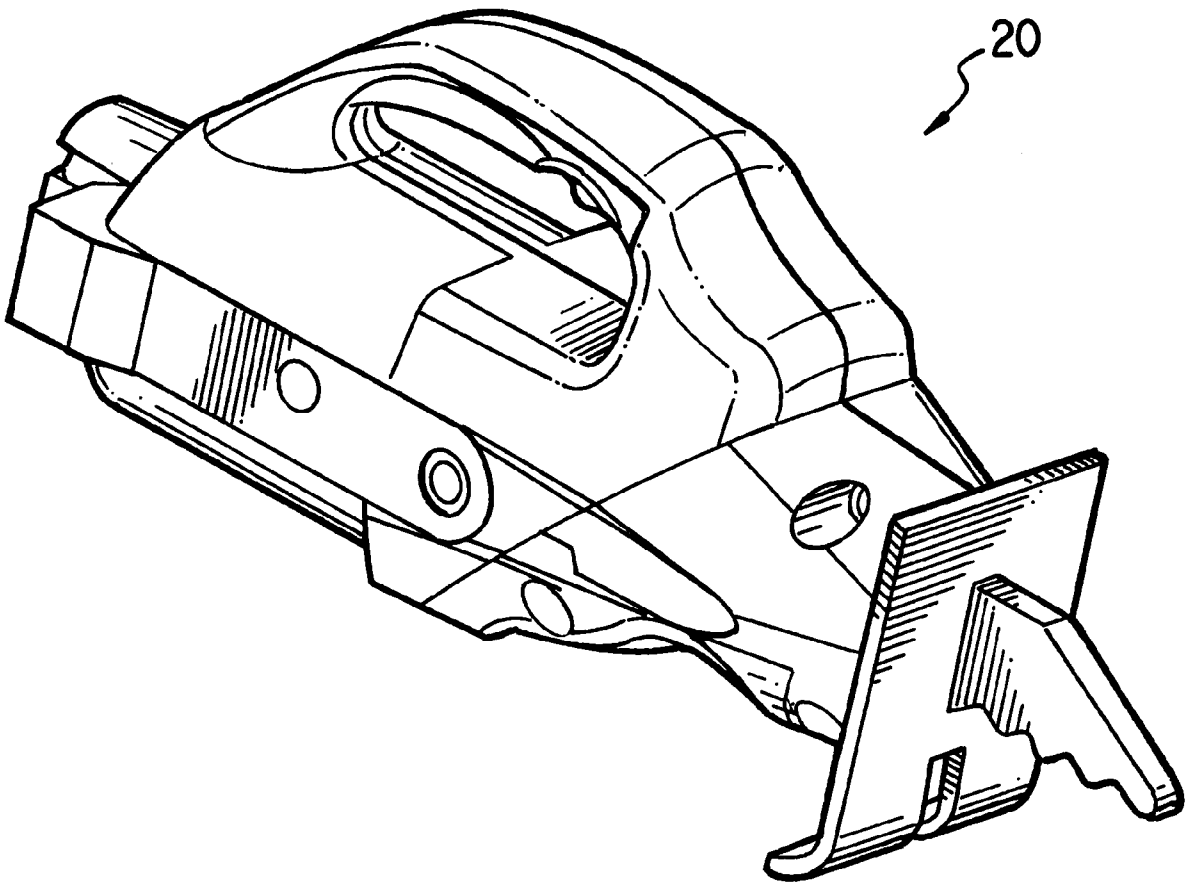
FIG. 1 is a perspective view of the toy power change saw in a straight configuration.
Figure 2:
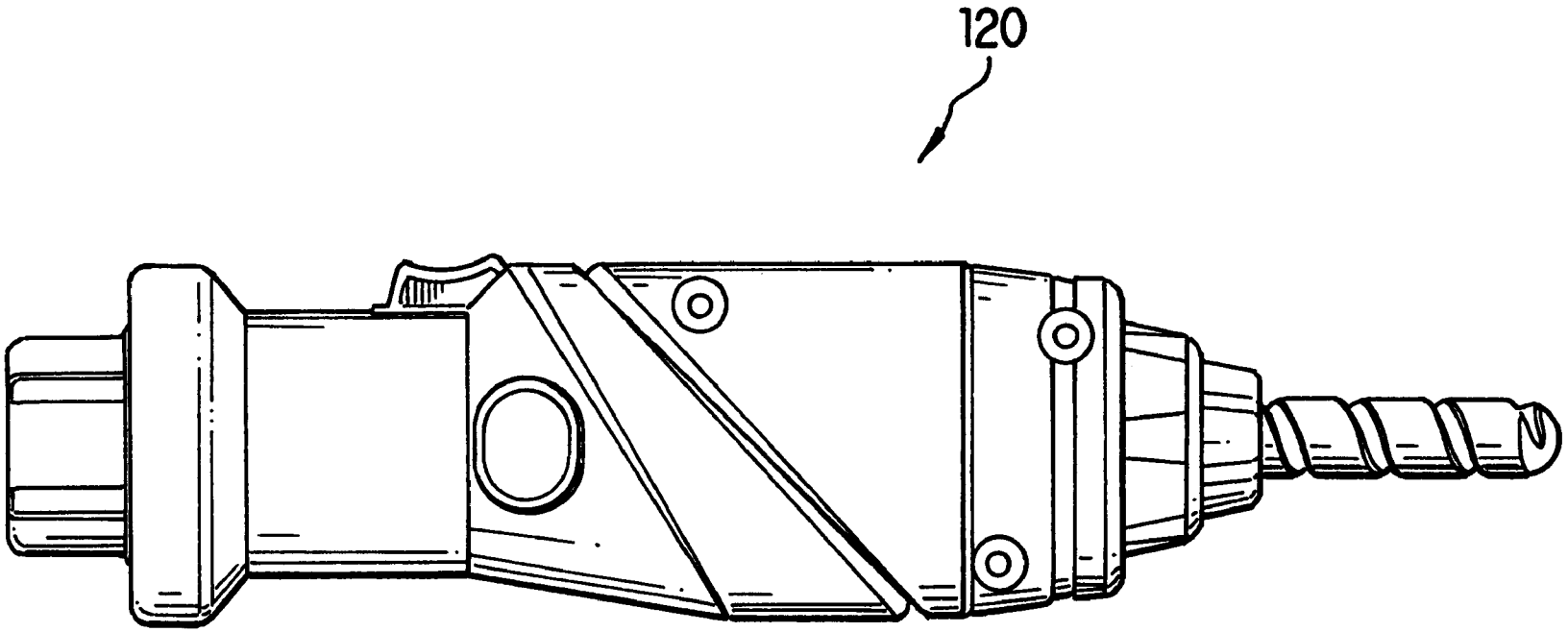
FIG. 2 is a perspective view of the toy power change drill in a straight configuration.

Reference will now be made in detail to the present preferred embodiments of the invention, examples of which are illustrated in the accompanying drawings. Throughout the following description, every reference character "n" for parts on the toy power change jigsaw/reciprocating saw 20, shown in FIG. 1, corresponds to reference characters "100+n" for similar parts on the toy power change drill/screwdriver 120, shown in FIG. 2.

Figure 3A:
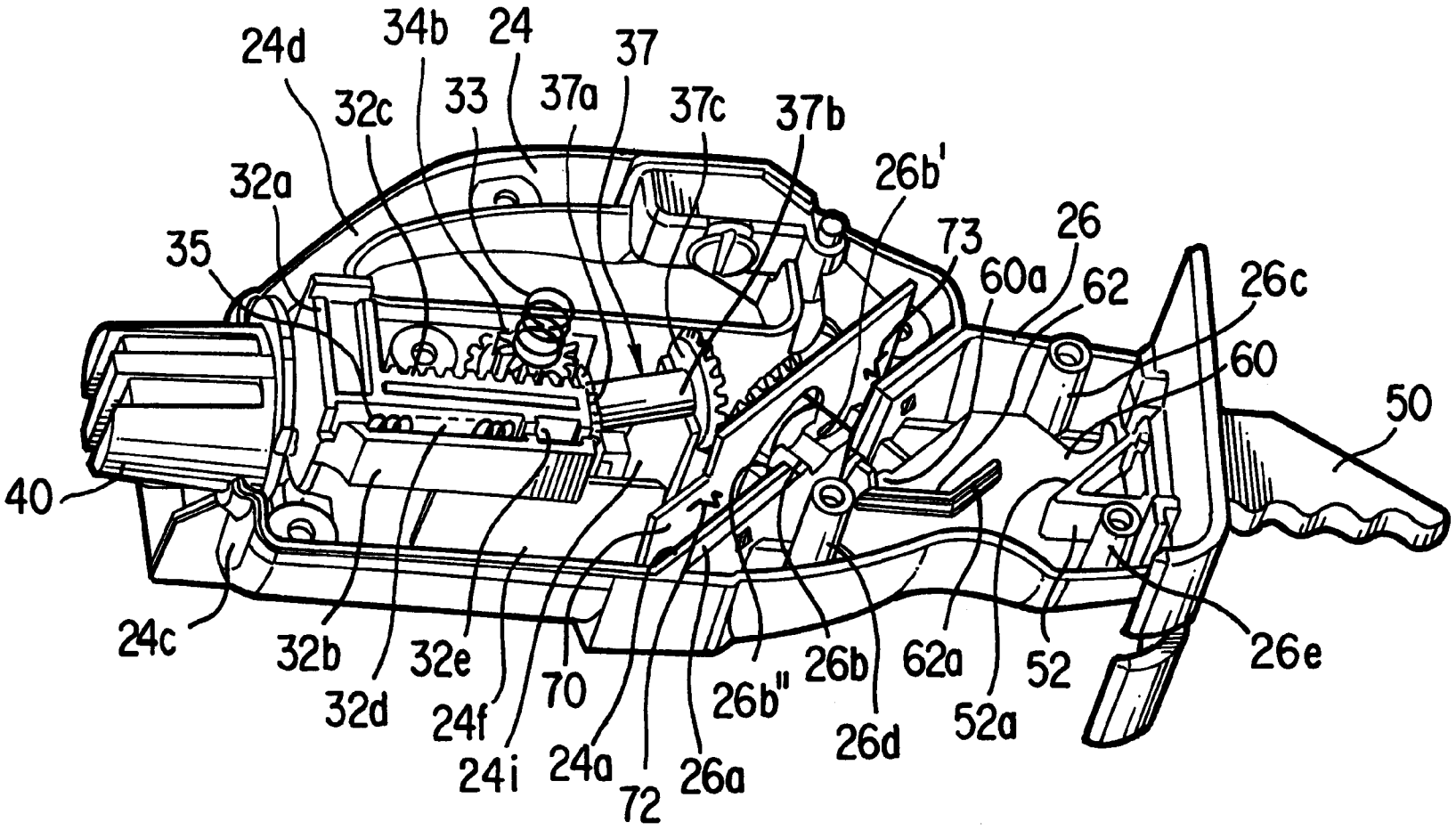
FIGS. 3A–3C are partially cut away perspective views of the toy power change saw.
Figure 3B:
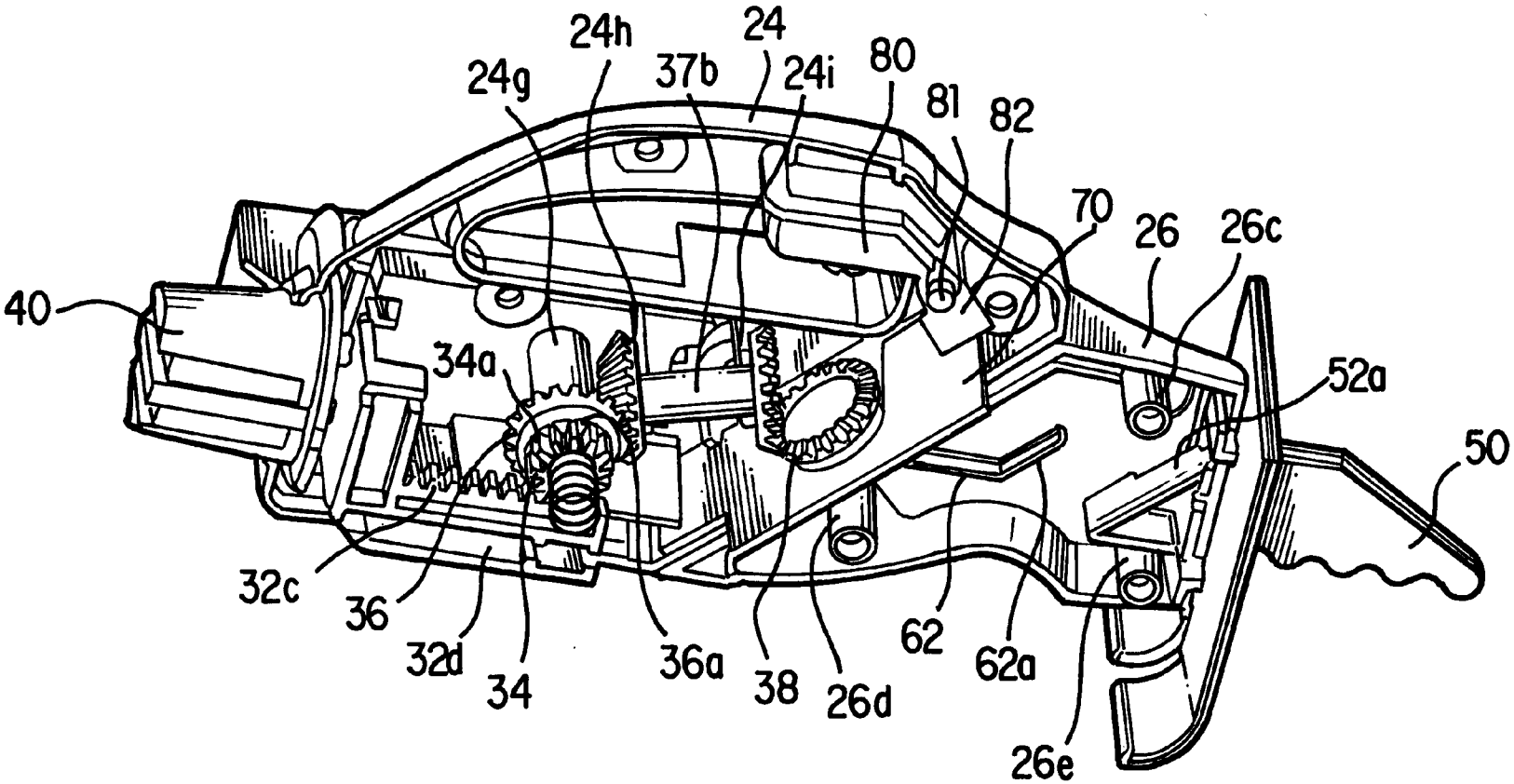

Referring initially to FIGS. 3A and 3B, an embodiment of the invention in the form of a toy jigsaw is shown. The jigsaw includes a tool-holding housing 26 that is rotatably connected with a handle housing 24. Interfacing surfaces 26*a* and 24*a* of the tool-holding housing and handle housing are parallel to each other and inclined relative to the central axes of both housings. A 180° rotation of the tool-holding housing 26 relative to the handle housing 24 changes the tool between the straight configuration shown in FIGS. 3A and 3B with the central axes of the housings aligned, and a right-angled, L-shaped configuration. Although the figures only show embodiments wherein first and second housings are rotated 180° relative to each other about an axis that is perpendicular to interfacing surfaces that intersect the central axes at 45°, the artisan will recognize that other configurations are possible. The housings could be rotated between multiple positions, such as 120° spaced positions, with the axes of the housings intersecting at different angles than just straight and right-angled configurations.

Both housings 24, 26 are preferably injection molded plastic and are each made up of two longitudinal halves, with only one half of the toy being shown in the figures. The interfacing surface 26*a* of tool-holding housing 26 includes a central boss portion 26*b* that extends at right angles to interfacing surface 26*a*. A smaller diameter portion 26*b*' extends through a central opening in the interfacing surface 24*a* of handle housing 24. The outer circumference of the smaller diameter portion 26*b*' forms a bearing surface that rotatably supports handle housing 24. The central boss 26*b* also includes a larger diameter portion 26*b*" that forms a shoulder for trapping interfacing surface 24*a* parallel to interfacing surface 26*a* and positioning the housings for rotation about a transformation axis that forms the central axis of the boss 26*b* perpendicular to the interfacing surfaces.

Figure 4A:
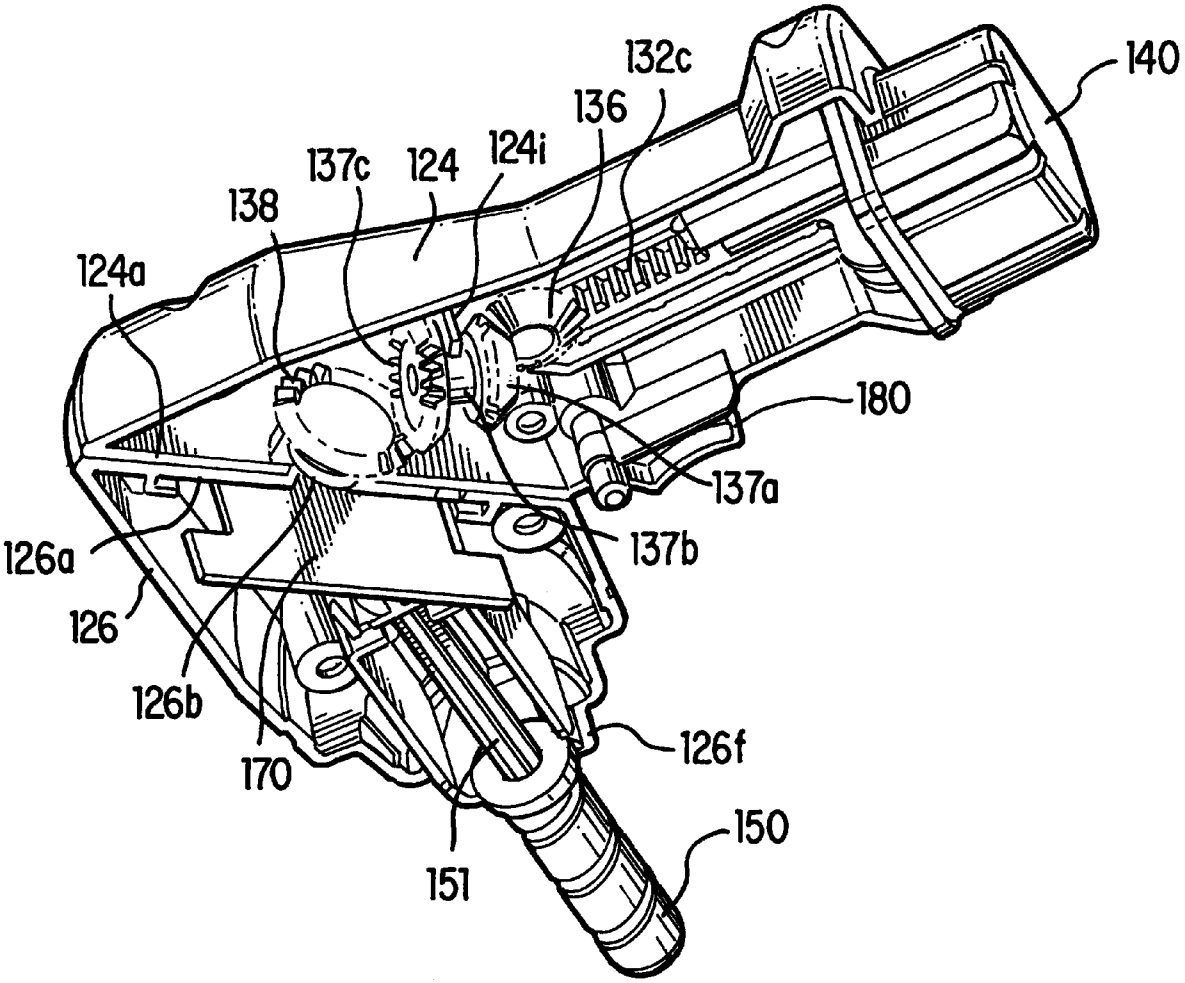
FIG. 4A is a partially cut away perspective view of the toy power change drill.
Figure 4B:
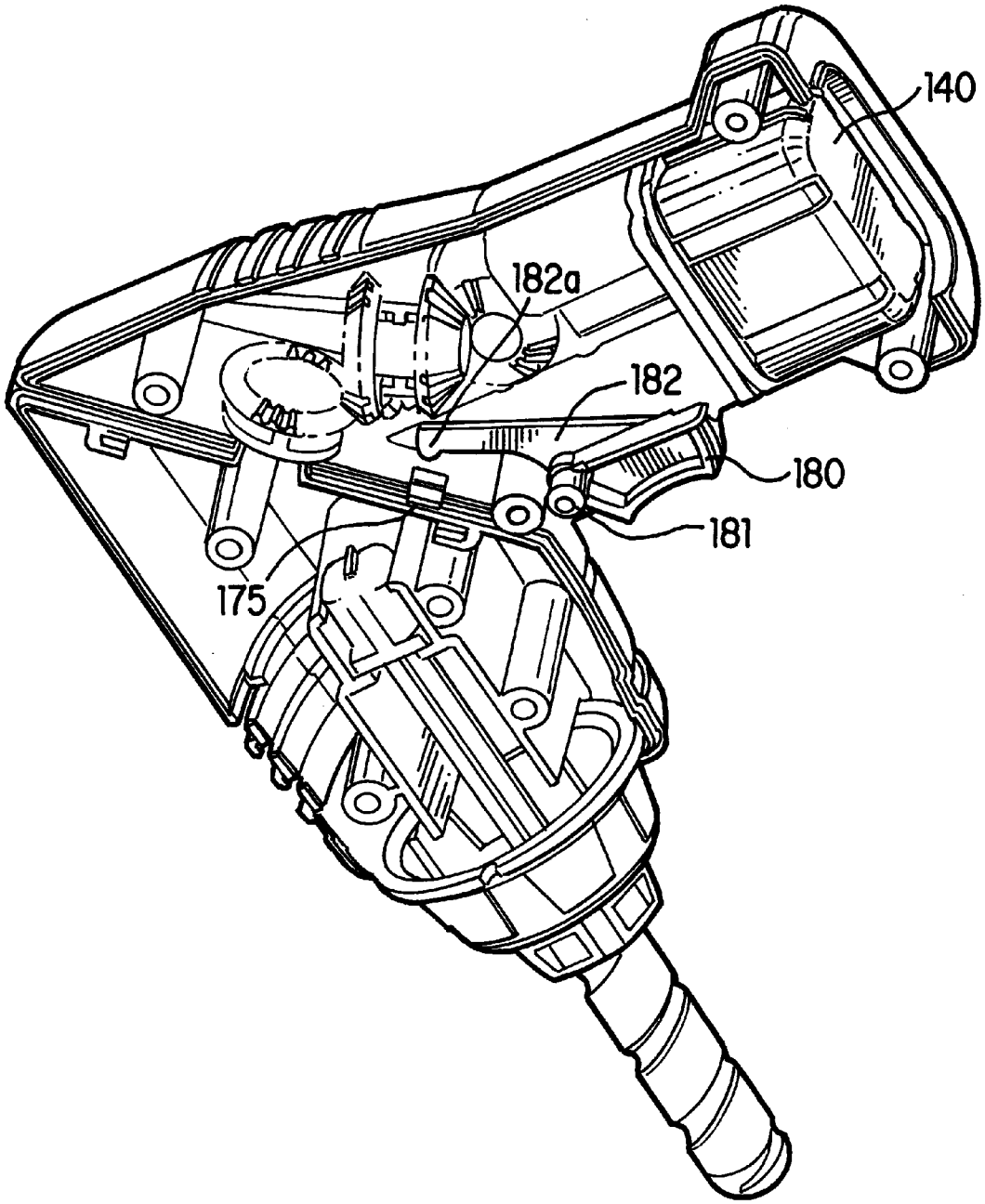
FIG. 4B is a partially cut away perspective view of the toy power change drill of FIG. 4A with the actuator button in a depressed position.
Figure 4C:
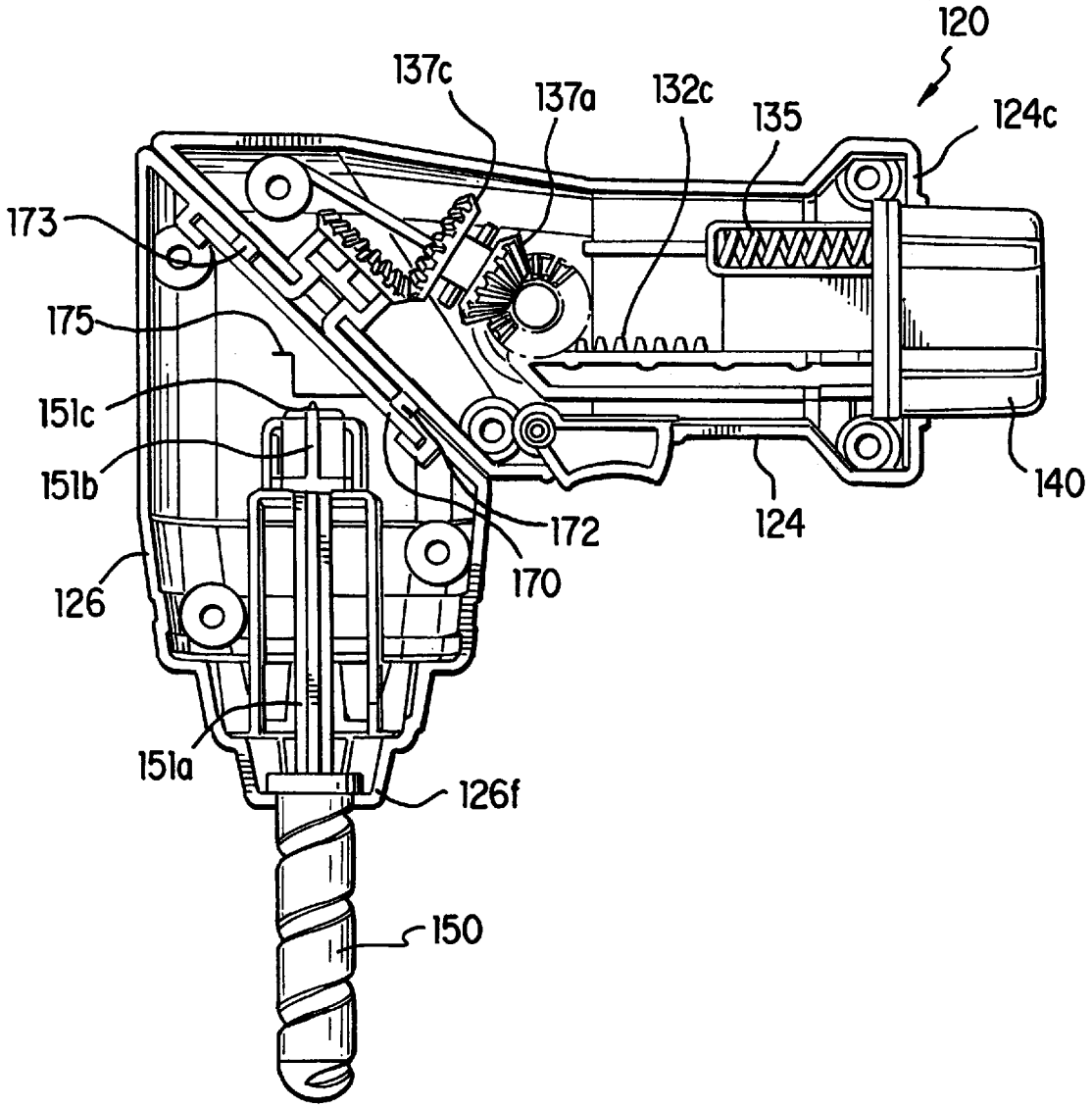
FIG. 4C is a side view partially cut away of the power change drill shown in FIG. 4A.
Figure 4D:
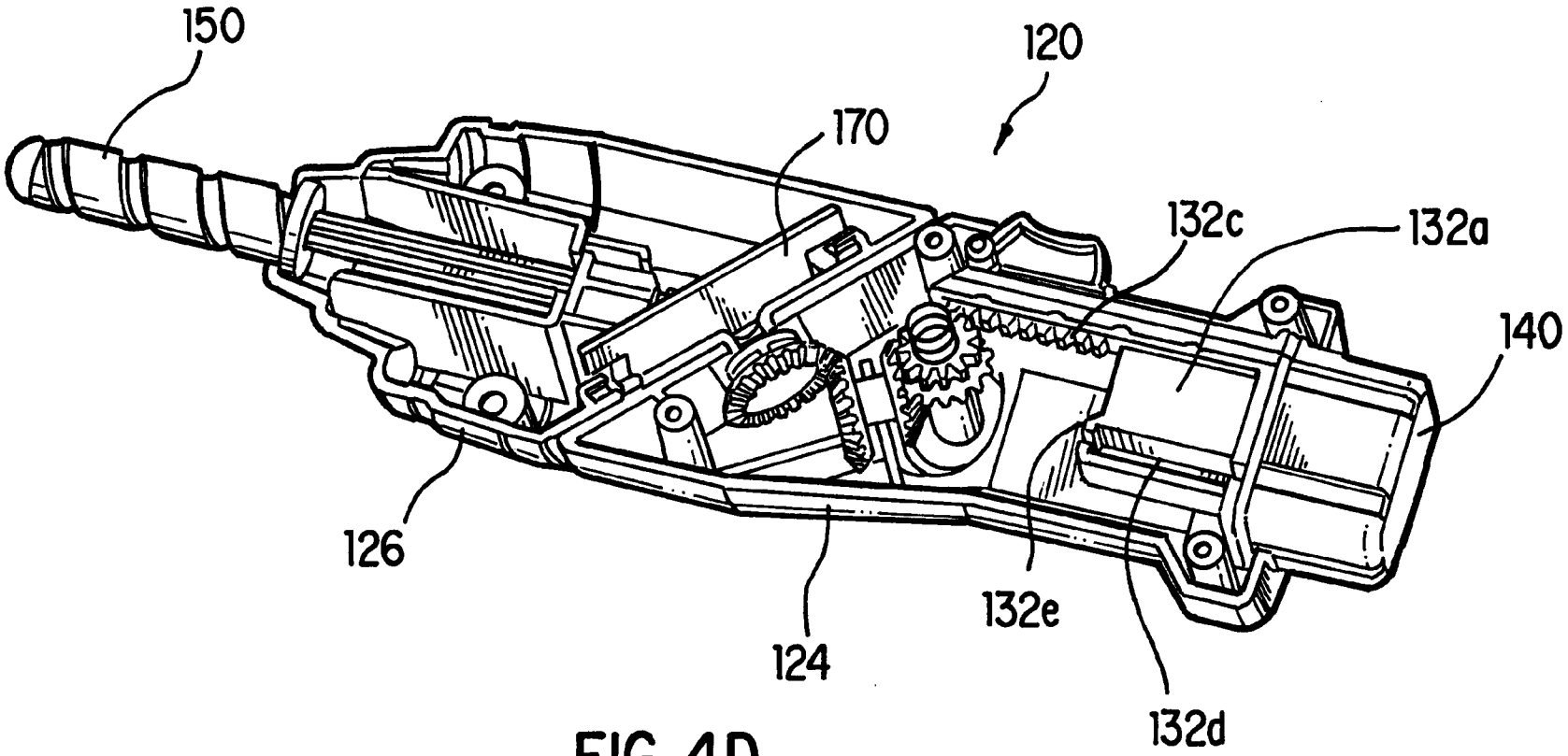
FIG. 4D is a partially cut away perspective view of the power change drill of FIG. 4A transformed to a straight configuration.

FIGS. 4A–4C show another embodiment of the invention in the form of a toy power drill with the central axis of the tool-holding housing 126 being positioned at a right angle to the central axis of the handle housing 124. A 180° rotation of the tool-holding housing 126 about the central transformation axis through central boss 126*b* transforms the toy drill into the configuration shown in FIG. 4D, wherein the central axes of the housings are aligned. The drill bit shown in the figures could also be replaced with a toy screwdriver bit. A 180° rotation of the tool-holding housing 26 of the toy jigsaw relative to the handle housing 24 would transform the jigsaw from the straight configuration shown in the figures to a right-angled configuration in the form of a reciprocating saw.

The mechanism for transforming the power change tools from one configuration to another will now be described with reference to FIGS. 3A–3C. An actuator button 40 protrudes through an opening in an end 24*c* of handle housing 24. Actuator button 40 is connected with a rack gear 32 and mounted in the handle housing 24 for linear, reciprocative motion into and out of the handle housing. Rack gear 32 includes a proximal box portion 32*a,* a spring compartment 32*b,* and rack gear teeth 32*c* cantilevered out from the proximal box portion 32*a.* An opening 32*e* at the end of spring compartment 32*b* opposite from proximal box portion 32*a* receives a guide rib 24*f* protruding inwardly from a side wall of handle housing 24. A compression spring 35 is contained within the space 32*d* defined by spring compartment 32*b* between the proximal box portion 32*a* and the fixed guide rib 24*f.* As the actuator button and rack gear are moved linearly into the handle housing, spring 35 is compressed.

Figure 3C:
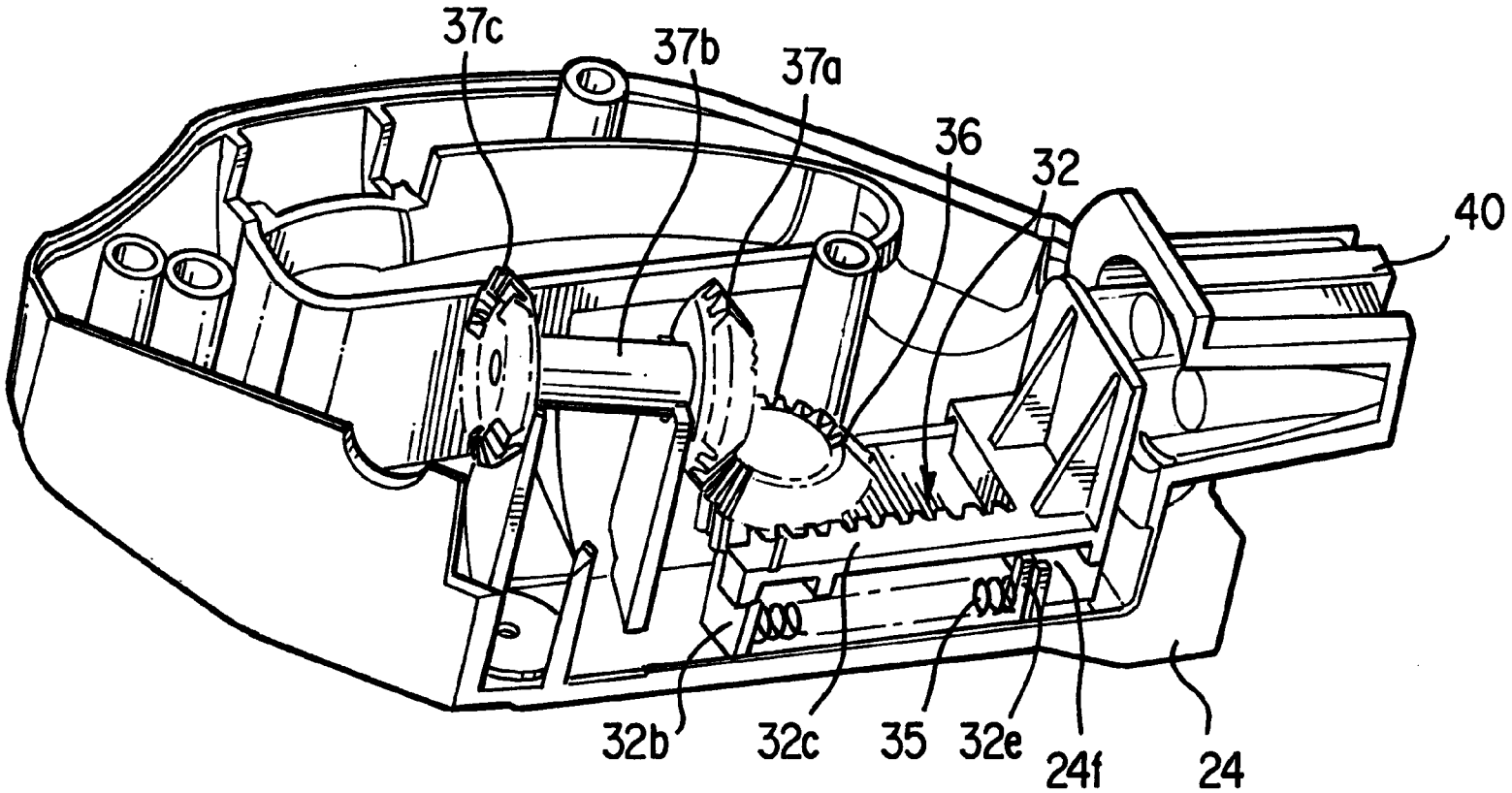

In a preferred embodiment of the toy jigsaw as shown in FIG. 3C, the spring compartment 32*b* can be formed as an integrally molded portion of the handle housing 24, with guide rib 24*f* being formed as part of the rack gear 32. In such an embodiment, the compression spring 35 is contained within the space 32*d* defined by spring compartment 32*b* on the handle housing 24. The rib 24*f* is integrally molded as part of the rack 32 and protrudes into spring compartment 32*b* through opening 32*e* to compress spring 35 as the rack 32 moves into the handle housing 24.

Rack gear teeth 32*c* are formed above the spring compartment 32*b* in the case of the toy jigsaw shown in FIGS. 3A and 3B. However, as shown in FIGS. 4A–4C with regard to the toy drill embodiment, the spring compartment and guide rib could also be formed above the rack gear teeth. Spring 35 is compressed in spring compartment 32*b* against guide rib 24*f* as the actuator button 40 is pushed into handle housing 24, and causes the rack gear 32 and actuator button 40 to return to the extended position upon release.

Figure 4E:
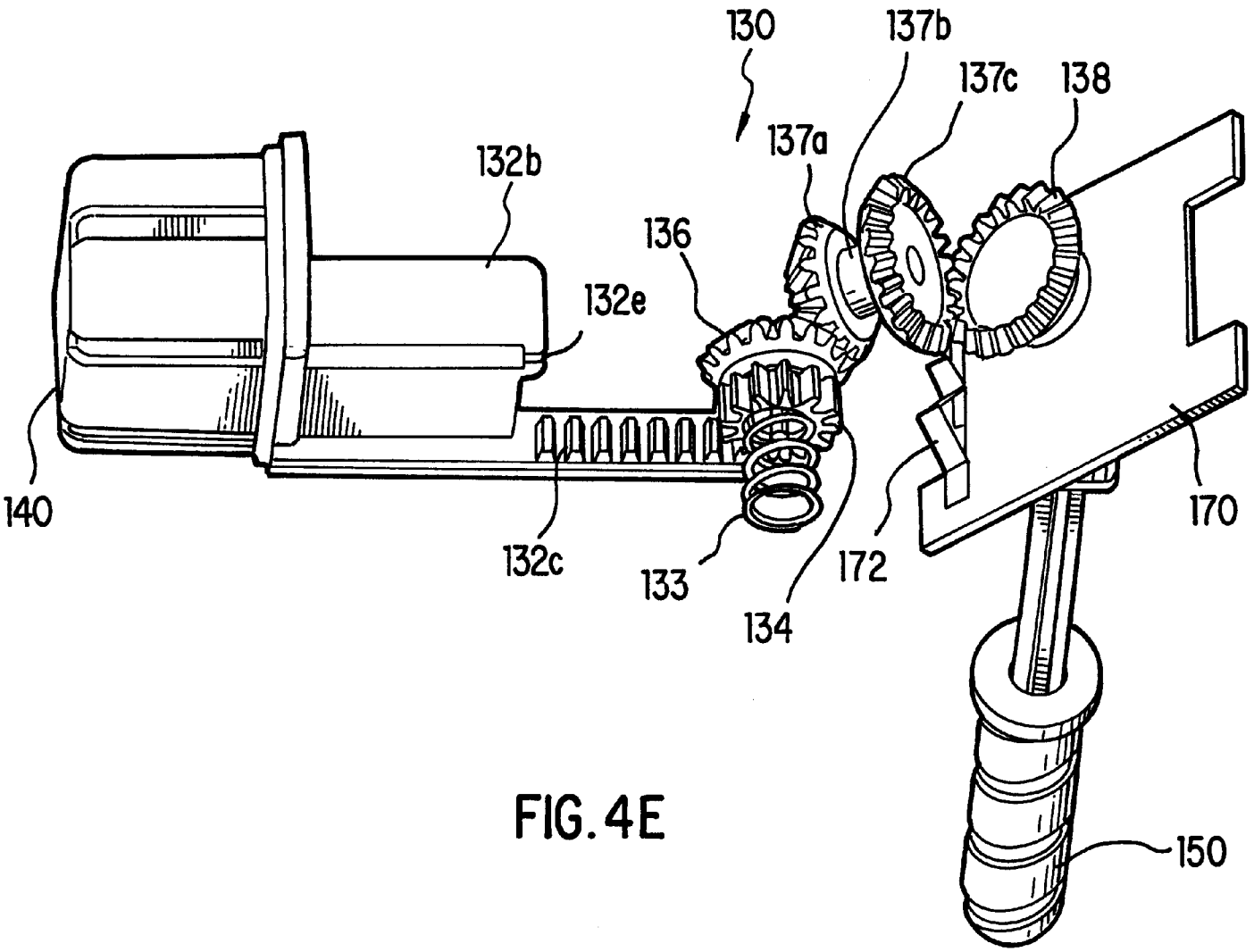
FIG. 4E is a perspective view of the transformation mechanism for the power change drill.
Figure 4F:
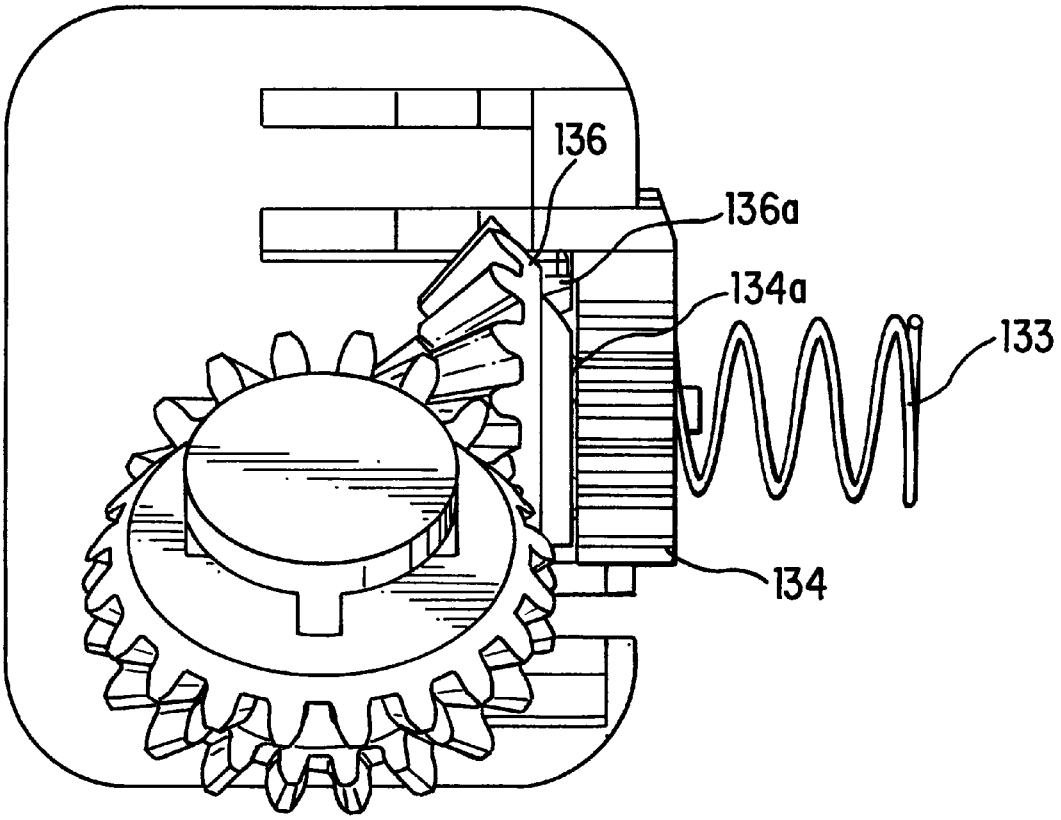
FIG. 4F is a perspective view of the gear train of the transformation mechanism.

Rack gear teeth 32*c* are engaged with a clutch spur gear 34 and cause the clutch spur gear to rotate as the rack gear travels into and out of the handle housing. Clutch spur gear 34 is provided with clutch teeth 34*a* that extend laterally from one side face and are selectively engaged with corresponding clutch teeth 36*a* extending laterally from one side of a clutch bevel gear 36. The clutch spur gear and clutch bevel gear are preferably formed from injection molded plastic and are rotatably supported on a boss 24*g* molded integrally with handle housing 24. A compression spring 33 exerts a lateral force on clutch spur gear 34 and biases the clutch spur gear clutch teeth 34*a* into engagement with the clutch bevel gear clutch teeth 36*a.* FIGS. 4E and 4F show the gear mechanism for the toy power change drill/screwdriver, wherein compression spring 133 exerts a lateral force on clutch spur gear 134 and biases clutch spur gear clutch teeth 134*a* into engagement with the clutch bevel gear clutch teeth 136*a.*

The gear train of the transformation mechanism can further include a double bevel gear 37 having one bevel gear 37*a* engaged with clutch bevel gear 36, a connecting shaft 37*b* and a second bevel gear 37*c.* The connecting shaft 37*b* is rotatably supported by ribs 24*h* and 24*i* of handle housing 24, as best seen in FIG. 3B. Corresponding ribs (not shown) of the other half of the handle housing would mate with ribs 24*h* and 24*i* to form the other half of the support for connecting shaft 37*b.* The second bevel gear 37*c* of the double bevel gear is engaged with an output bevel gear 38 that is nonrotatably mounted in the larger diameter portion 26*b*" of central boss 26*b* on tool-holding housing 26.

As the actuator button 40 is pushed into the handle housing, the spur gear 34 is rotated in a first direction by engagement of spur gear teeth 34*b* with rack gear teeth 32*c.* A number of design factors determine whether the clutch spur gear 34 will positively engage with the clutch bevel gear 36 as the rack gear 32 moves into the handle housing 24 or as compression spring 35 returns the rack gear and actuator button to an extended position. The engaging surfaces of the spur gear clutch teeth 34*a* on one side face of the clutch spur gear 34 and the bevel gear clutch teeth 36*a* can be designed with a more gradual slope in the direction of rotation of the gears as the rack gear is pushed into the housing, and a steeper slope in the direction of rotation of the gears as the rack gear is returned to its extended position. A more gradual slope in the direction of rotation tends to allow the clutch to slip as compression spring 33 is compressed and the spur gear moves away from the bevel gear. The slope of the clutch teeth constitutes one design factor that can be varied to determine the direction of rotation of the clutch spur gear that results in a positive engagement with the clutch bevel gear and thereby rotates the tool-holding housing relative to the handle housing.

In a preferred embodiment, instead of relying on the slope of the clutch teeth to determine the direction of rotation of the tool-holding housing relative to the handle housing, detents 72, 73 provided between the interfacing surfaces 24*a* and 26*a* create more resistance to relative rotation in one direction than in the opposite direction. The detents 72 and 73 are spring switches mounted on the printed circuit board 70 at 180° spaced locations and extending toward the interfacing surfaces 24*a* and 26*a.*

Figure 5B:
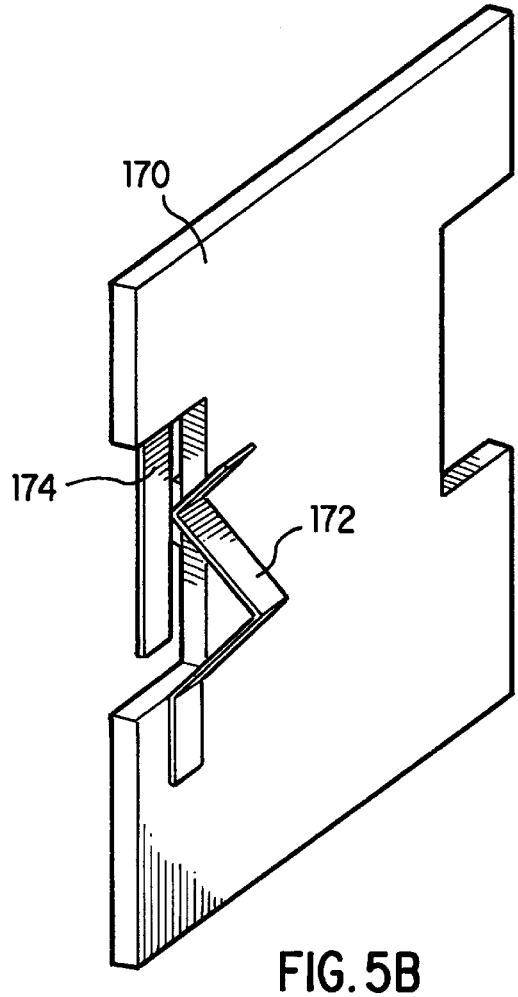
FIGS. 5A and 5B show details of the detent/switches mounted on the printed circuit board adjacent interfacing surfaces of the housings.
Figure 5A:
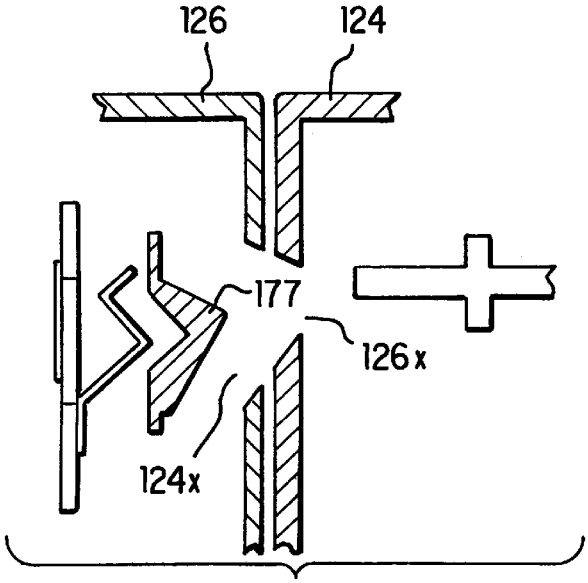

In the case of a toy power change drill/screwdriver, as shown in FIGS. 4A–4F, the detents 172 and 173 are spring switches mounted on the printed circuit board 170 at 180° spaced locations. The printed circuit board for the power change drill is mounted parallel to interfacing surfaces 124*a* and 126*a* in the tool-holding housing 126. As best seen in FIGS. 5A and 5B, when the handle housing 124 and the tool-holding housing 126 are positioned relative to each other in either a straight configuration or a right-angled configuration, plastic molded contact covers 177 over the detent/switches 172 and 173 project through aligned openings 124*x* and 126*x* in the interfacing surfaces. The detent/switches maintain the housings in one of the desired configurations with the associated switches being open at these positions.

The slope of the contact covers on the detent switches projecting through openings in the interfacing surfaces is different in one direction of rotation of the housings than in the opposite direction. A more gradual slope on the engaging surfaces of the detent contact covers and the associated openings through the interfacing surfaces in a first direction of rotation offers less resistance to rotation in the first direction. Accordingly, the clutch spur gear and clutch bevel gear will remain positively engaged and the transformation of the power change tool will take place. A steeper slope on the engaging surfaces of the detent contact covers and the associated openings through the interfacing surfaces in the opposite direction of rotation offers more resistance to rotation. With sufficient resistance to relative rotation between the housings, the compression spring 133 is overcome by the lateral force on the clutch spur gear 134, and the clutch spur gear slips relative to the clutch bevel gear 136.

In a preferred embodiment the rack gear 32 (132) must be pushed all the way into the handle housing and then released to commence a transformation of the tool configuration. The detent switches 72, 73 are spaced at 180° to correspond to a straight configuration wherein the central axes of the housings are aligned and a gun-shaped configuration wherein the central axes of the housings are at right angles. As the rack gear 32 is pushed into the handle housing the clutch spur gear 34 rotates relative to the clutch bevel gear 36 since the resistance to relative rotation of the housings generated by the detent switches causes the clutch teeth to slip as spring 33 is compressed. With the rack gear 32 pushed all the way into the housing, the clutch teeth 34*a* on the spur gear 34 are engaged with the corresponding clutch teeth 36*a* on the bevel gear 36. The compression spring 35 is fully compressed within spring compartment 32*b* and, upon release of actuator button 40, returns the rack gear to its fully extended position. The resistance to relative rotation of the housings created by the detent springs in this direction is smaller than the resistance to clutch slippage created by spring 33, so the clutch spur gear remains positively engaged with the clutch bevel gear and the transformation takes place as the rack gear is extended by spring 35.

As mentioned above, the detents 72, 73 also serve as switch contacts on printed circuit board 70. When the tool-holding housing 26 is rotated relative to the handle housing 24 the detents move out of the openings through the interfacing surfaces and are compressed, thus closing switches associated with sound producing circuits on the printed circuit board. A sound generated by the closing of both detent switches at the same time can simulate electronic motor noises to produce a realistic transformation sound effect. In an alternative embodiment, a separate switch could be provided between the interfacing surfaces in a position such that it would be depressed whenever the two housings were in any position other than the positions where the detents protrude through openings in the interfacing surfaces.

A trigger 80 is also provided on the handle housing 24, pivotally mounted at pin 81 such that distal end 82 of the trigger 80 can contact and close one of the detent switches 72, 73 when the housings are in either the straight or right-angled configurations. In these predetermined desired configurations the detent/switches protrude through openings in the interfacing surfaces as described above. Alternative embodiments could include any desired number of detents and fixed positions. With a greater number of detents, the central axes of the housings would intersect at angles other than 180° and 90° at the fixed positions assumed by the housings with engagement of the detents. When a detent/switch is aligned with a corresponding opening through the interfacing surfaces the switch is in an open position. Closing of one of the detent/switches can cause the associated sound producing circuit on printed circuit board 70 to produce an electronic motor sound different from the transformation sound produced when both detent switches are closed.

An additional feature of the power change tool allows for the generation of a cutting sound that is a realistic simulation of the cutting sound produced by whatever cutting bit is mounted on the tool. A simulated jigsaw blade 50 is shown in FIGS. 3A and 3B, and is mounted for linear motion into and out of end 26*f* of tool-holding housing 26. In an alternative embodiment shown in FIGS. 4A–4D, a simulated drill bit 150 is mounted for linear, and if desired, rotary motion into and out of the end 126*f* of tool-holding housing 126.

Pressure on the end of drill bit 150 causes a spring (not shown) between the end of guide rod 151 and the drill bit 150 to be compressed as the drill bit moves into the housing. A cam pin (not shown) can also be provided at the end 126*f* in engagement with the helical groove around the drill bit so that the drill bit rotates as it moves into and out of the housing. Immediately upon exerting a force on the end of drill bit 150, the force is transmitted through the spring at the end 151*a* of guide rod 151, through guide rod 151, and to a switch 175 mounted on printed circuit board 170. The spring rate of the switch 175 is chosen to be less than that of the compression spring between the end 151 a of guide rod 151 and drill bit 150. Therefore, a force sufficient to move the drill bit along the guide rod 151 and into the end 126*f* of the tool-holding housing is sufficient to activate switch 175, thus producing a desired drilling sound. In a preferred embodiment, activation of switch 175 alone by pressing the drill bit into the tool-holding housing will not produce a cutting sound. Switch 175 must be closed at the same time one of the detent/switches 172, 173 is closed by trigger arm 182*a* to produce a drilling sound. It will be clear to the artisan that various combinations of switches can be provided, with the required sequences and combinations of activation of the switches being designed to provide realism and educational value.

FIG. 4B illustrates the toy power change drill in an activated position with the actuator button fully depressed. At this position the rack gear 132 has moved into the housing far enough to rotate the clutch spur gear 134 relative to the clutch bevel gear 136 until the clutch teeth 134*a* and 136*a* are engaged. Release of the actuator button 141 allows spring 135 to bias the rack and actuator button to their fully extended position. If the actuator button is not fully depressed the clutch spur gear will not have rotated far enough relative to the clutch bevel gear to reach the position where their respective clutch teeth are engaged. In such a case the release of the actuator button will return the rack gear to its fully extended position, but no transformation in configuration of the tool will occur.

If it is desired that the transformation of the power change tool occur while the actuator button is being depressed, it is necessary to choose the design factors discussed above such that the clutch spur gear will not slip relative to the clutch bevel gear while the actuator button is being depressed. The slopes of the engaging faces of the detent/switch contact covers 177 (77) and the corresponding openings 124*x*, 126*x* through the interfacing surfaces 124, 126 are chosen to impose less resistance to relative rotation between the housings in the direction of rotation caused by moving the rack into the housing. As a result, the clutch spur gear remains engaged with the clutch bevel gear while the rack is traveling into the housing, thus causing transformation of the power change tool.

It will be apparent to those skilled in the art that various modifications and variations can be made in the power change tool of the present invention and in construction of the internal mechanisms without departing from the scope or spirit of the invention. As an example, the tool-holding housing and handle housing could be rotatably connected in various ways that allow the angle between the central axes of the two housings to be varied. Rotary bearings could be provided at the outer circumferences of the interfacing surfaces between the two housings rather than using the central boss of the tool-holding housing as the bearing support for the handle housing. The angles between the central axes of the housings at the desired fixed positions can be varied by changing the number and spacing of the detents that interact with the interfacing surfaces. Alternative mechanisms for converting linear input motion into rotary motion of the two housings could include crankshaft and connecting rod type mechanisms etc. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A toy tool, comprising a first housing having a first central axis;

a second housing having a second central axis and being rotatably connected to said first housing at an interfacing surface that is inclined at an angle relative to said first and second central axes; and an actuator mounted to said first housing and having an input portion, said actuator converting linear motion of said input portion with respect to said first housing into relative rotation between said first housing and said second housing.

2. The toy tool according to claim 1, wherein said actuator includes a gear train mounted within said first housing, said gear train including a bevel gear that can be rotated to cause said second housing to rotate relative to said first housing between a position wherein said first and second central axes are substantially aligned and a position wherein said first and second central axes are substantially perpendicular to each other.

3. The toy tool according to claim 2, wherein said second housing supports a simulated tool for movement into and out of said second housing parallel to said second central axis.

4. The toy tool according to claim 3, further including an electronic sound generating circuit that produces a cutting sound when said simulated tool is moved into said second housing.

5. The toy tool according to claim 4, wherein a trigger is movably mounted on said first housing, and said electronic sound generating circuit produces the cutting sound when said simulated tool is moved into said second housing at the same time as said trigger on said first housing is actuated.

6. The toy tool according to claim 5, wherein said electronic sound generating circuit produces an electronic transformation sound when said second housing is rotated relative to said first housing about a transformation axis perpendicular to said interfacing surface.

7. The toy tool according to claim 3, wherein said simulated tool is a toy screwdriver bit when said first and second central axes are aligned.

8. The toy tool according to claim 3, wherein said simulated tool is a toy drill bit when said first and second central axes are perpendicular to each other.

9. The toy tool according to claim 3, wherein said simulated tool is a toy sawblade.

10. The toy tool according to claim 2, wherein said gear train further includes a rack mounted in said first housing to said input portion of said actuator for linear motion, said rack engaging a spur gear and said spur gear being interconnected through a clutch to said bevel gear.

11. A toy tool, comprising:

a tool-holding housing having a first central axis;

a handle housing having a second central axis and being rotatably connected to said tool-holding housing at an interfacing surface disposed at an angle with respect to said first and second axes such that said tool-holding housing can be rotated about a transformation axis that is substantially perpendicular to said interfacing surface to move said tool-holding housing between a first position wherein said first central axis forms a first angle with said second central axis and a second position wherein said first central axis forms a second angle different from said first angle with said second central axis;

an actuator that causes said tool-holding housing to rotate about said transformation axis; and said actuator converts a linear input to said actuator to rotary motion of said tool-holding housing.

12. The toy tool according to claim 11, wherein said actuator includes a rack gear that is moved linearly relative to said handle housing upon receipt of said linear input;

a spur gear engaged with said rack gear;

a first bevel gear selectively connected with said spur gear through a clutch mechanism; and a second bevel gear nonrotatably connected to said tool-holding housing.

13. The toy tool according to claim 11, further including a simulated tool mounted in said tool-holding housing for movement into and out of said tool-holding housing parallel to said first central axis.

14. The toy tool according to claim 13, further including an electronic sound generating circuit that produces a cutting sound when said simulated tool is moved into said tool-holding housing.

15. A toy tool, comprising:

a handle having a first central axis and a tool-holder having a second central axis;

said handle being rotatably connected to said tool-holder at substantially parallel interfacing surfaces of said handle and said tool-holder for relative rotation about a transformation axis that is substantially perpendicular to said parallel interfacing surfaces and that is oblique to said central axes; and actuation means for converting a linear motion input to said tool into relative rotation of said handle and said tool-holder.

16. The toy tool according to claim 15, wherein said actuation means comprises a button, a rack gear connected to said button, a compression spring biasing said rack gear in a first linear direction, a spur gear engaged with said rack gear and a bevel gear that is selectively engaged with said spur gear through a clutch.

17. The toy tool according to claim 16, wherein said rack gear is moved linearly into said handle by pressing on said button, and wherein said bevel gear is engaged with said spur gear through said clutch when said rack gear is moved in said first linear direction by said compression spring.

18. The toy tool according to claim 17, wherein movement of said rack gear in said first linear direction causes said bevel gear to rotate said tool-holder relative to said handle.

19. The toy tool according to claim 18, further including a printed circuit board mounted parallel and adjacent to said interfacing surfaces;

detents being mounted on said printed circuit board and extending into aligned openings through said interfacing surfaces when said handle and said tool-holder are positioned with their central axes aligned and when their central axes are perpendicular.

20. The toy tool according to claim 19, wherein said detents are also switches in sound producing circuits on said printed circuit board.

21. The toy tool according to claim 20, further including a simulated tool bit mounted for movement into and out of said tool-holder wherein movement of said simulated tool bit into said tool-holder actuates another switch in said sound producing circuits.

22. A sound generating toy tool, comprising:

a sound output device producing a first sound simulating a motor, and a second sound simulating operation of the tool on a workpiece;

a first switch coupled to a trigger and to said sound output device and moved to an operation position by movement of said trigger;

a second switch coupled to a simulated tool and to said sound output device and moved to an operation position by movement of said simulated tool, said sound output device producing said first sound when said trigger is moved and producing said second sound when both said trigger and said simulated tool are moved at the same time.

23. The sound generating toy tool according to claim 22, further including a first housing having a first central axis and a second housing having a second central axis;

said first housing being rotatably connected to said second housing at an interfacing surface that is inclined at an angle relative to said first and second central axes; and a detent provided at said interfacing surface to position said first and second housings in a desired configuration with respect to each other, said detent forming a third switch coupled to said sound output device and being moved to an operation position to cause said sound output device to produce a third sound when said first and second housings are moved away from said desired configuration.

24. The sound generating toy according to claim 23, further including an actuator mounted to said first housing and having an input portion, said actuator converting linear motion of said input portion with respect to said first housing into relative rotation between said first housing and said second housing.

25. A method of transforming a toy tool, wherein the toy tool includes first and second housings, said first and second housings being rotatably connected at interfacing surfaces that are inclined at an angle relative to the central axes of the first and second housings, and an actuator mounted to said first housing and having an input portion; said method comprising:

rotating said second housing relative to said first housing about an axis perpendicular to said interfacing surfaces, said rotating being performed by moving said input portion with respect to said first housing in a linear direction; and stopping rotation of said second housing relative to said first housing when the central axis of said second housing is at a desired angle relative to the central axis of said first housing.

26. The method according to claim 25, wherein said step of stopping rotation of said second housing relative to said first housing includes engaging a detent mounted within said first housing with a recess in said second housing.

27. The method according to claim 25, further including producing a simulated motor sound during said rotating step.

28. The method according to claim 27, wherein said toy tool further includes a simulated cutting tool mounted for movement relative to said second housing, said method further including producing a sound simulating operation of said toy tool on a workpiece when said simulated cutting tool moves relative to said second housing.

* * * * *

UNITED STATES PATENT AND TRADEMARK OFFICE

CERTIFICATE OF CORRECTION

PATENT NO. : 6,062,939
DATED : May 16, 2000
INVENTOR(S) : Parker et al.

It is certified that error appears in the above-identified patent and that said Letters Patent is hereby corrected as shown below:

Item [56] References Cited:

U.S. PATENTS DOCUMENTS

| | | | |
|---|---|---|---|
| --3,864,873 | 2/1975 | Watkins | 46/232 |
| 4,334,384 | 6/1982 | Rogers et al | 46/39 |
| 4,713,036 | 12/1987 | Moomaw | 446/145-- |
| 4,932,913 | 6/1990 | Raviv et al | 446/404 |
| --4,995,846 | 2/1991 | Mariol | 446/376 |
| 5,069,091 | 12/1991 | Bramsiepe et al | 81/177 |
| 5,145,446 | 9/1992 | Kuo | 446/405 |
| 5,217,402 | 6/1993 | Gross et al | 446/1 |
| 5,346,418 | 9/1994 | Arad | 446/91 |
| 5,389,031 | 2/1995 | Sharpe, III et al. | 446/409-- |
| 5,785,572 | 6/1998 | Levy et al | 446/144 |

FOREIGN PATENT DOCUMENTS

| | | | |
|---|---|---|---|
| 716766 | 8/1965 | Canada | 446/38 |
| --GB 2 090 754 A | 7/1982 | Great Britain | A63H33/30-- |

Signed and Sealed this

Nineteenth Day of June, 2001

*Attest:*

Nicholas P. Godici

*Attesting Officer*

NICHOLAS P. GODICI
*Acting Director of the United States Patent and Trademark Office*